US008056155B1

(12) United States Patent
Goettl

(10) Patent No.: US 8,056,155 B1
(45) **Date of Patent: *Nov. 15, 2011**

(54) METHOD OF CLEANING A SWIMMING POOL

(75) Inventor: John M. Goettl, Phonix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/186,313

(22) Filed: Jul. 19, 2011

Related U.S. Application Data

(60) Continuation of application No. 11/924,400, filed on Oct. 25, 2007, now Pat. No. 7,979,924, which is a continuation-in-part of application No. 10/930,494, filed on Aug. 31, 2004, now Pat. No. 7,578,010, which is a division of application No. 10/406,333, filed on Apr. 3, 2003, now Pat. No. 6,848,124.

(51) Int. Cl.
*E04H 4/00* (2006.01)

(52) U.S. Cl. ..... 4/490; 4/661; 4/492; 239/236; 239/239; 74/129

(58) Field of Classification Search ..... 4/490, 492, 4/661, DIG. 9; 239/99, 201
See application file for complete search history.

(56) References Cited

U.S. PATENT DOCUMENTS 1,821,579 A 9/1931 Rader
1,964,269 A 6/1934 Munz
2,209,961 A 8/1940 De Lacy-Mulhall
2,214,852 A 9/1940 De Lacy-Mulhall
3,237,866 A 3/1966 Lovell
3,247,968 A 4/1966 Miller
3,247,969 A 4/1966 Miller
3,408,006 A 10/1968 Stanwood
3,449,772 A 6/1969 Werner
3,486,623 A 12/1969 Bosico
3,506,489 A 4/1970 Baker
3,515,351 A 6/1970 Costa
3,521,304 A 7/1970 Ghiz
3,675,252 A 7/1972 Ghiz
3,765,608 A 10/1973 Lockwood
3,955,764 A 5/1976 Phaup
4,114,204 A * 9/1978 Blach ..... 4/324
4,114,206 A 9/1978 Franc
4,188,673 A 2/1980 Carter
4,193,870 A 3/1980 Goodin
4,195,371 A 4/1980 Goodin
4,200,230 A 4/1980 Gould
4,202,499 A 5/1980 Mathews
4,212,088 A 7/1980 Goettl et al.
(Continued)

*Primary Examiner* — Brian Glessner
*Assistant Examiner* — Patrick Maestri
(74) *Attorney, Agent, or Firm* — Booth Udall, PLC

(57) ABSTRACT

Methods of cleaning a swimming pool using a swimming pool cleaning head. A first method may include intermittently raising a nozzle head under water and ejecting a stream of water under water, incrementally rotating the nozzle head in a clockwise direction, retracting the nozzle head, sliding a cam reverser, and reversing the direction of rotation of the nozzle head with the cam reverser to counterclockwise. A second method may include rotating a stem by sliding at least one pin coupled to the stem through at least one channel in a cam, the stem configured to release a stream of water under water in a swimming pool. The method may further include reversing the direction of rotation of the stem by sliding a slidable section of the cam with the at least one pin.

14 Claims, 9 Drawing Sheets

U.S. PATENT DOCUMENTS

| | | | |
|---|---|---|---|
| 4,271,541 | A | 6/1981 | Mathews |
| 4,276,163 | A | 6/1981 | Gordon |
| 4,322,860 | A | 4/1982 | Gould |
| 4,347,979 | A | 9/1982 | Mathews |
| 4,371,994 | A | 2/1983 | Mathews |
| 4,391,005 | A | 7/1983 | Goettl |
| 4,462,546 | A | 7/1984 | Pitman |
| 4,466,142 | A | 8/1984 | Gould |
| 4,471,908 | A | 9/1984 | Hunter |
| 4,520,514 | A | 6/1985 | Johnson |
| 4,568,024 | A | 2/1986 | Hunter |
| 4,592,379 | A | 6/1986 | Goettl |
| 4,939,797 | A | 7/1990 | Goettl |
| 5,135,579 | A | 8/1992 | Goettl |
| 5,251,343 | A | 10/1993 | Goettl |
| 5,333,788 | A | 8/1994 | Hadar |
| 5,826,797 | A | 10/1998 | Kah, III |
| 6,029,907 | A | 2/2000 | McKenzie |
| 6,085,995 | A | 7/2000 | Kah, Jr. et al. |
| 6,182,909 | B1 | 2/2001 | Kah, Jr. et al. |
| 6,237,862 | B1 | 5/2001 | Kah, III et al. |
| 6,301,723 | B1 | 10/2001 | Goettl |
| 6,367,098 | B1 | 4/2002 | Barnes |
| 6,393,629 | B1 | 5/2002 | Barnes et al. |
| 6,438,766 | B1 | 8/2002 | Arnau |
| 2004/0217210 | A1 * | 11/2004 | Goettl et al. ..... 239/548 |

* cited by examiner

ROTATION
REVERSER TRAVEL
EXTENDED
PIN TRAVEL
RETRACTED
46
48
50
110
112
114
116
118
120
122
110a
112a

METHOD OF CLEANING A SWIMMING POOL

CROSS REFERENCE TO RELATED APPLICATIONS

This application is a continuation application of the earlier U.S. Utility Patent Application to Goettl entitled "Cam Operated Swimming Pool Cleaning Nozzle," application Ser. No. 11/924,400, filed Oct. 25, 2007, which application was a continuation-in-part application of the earlier U.S. Utility Patent Application to Goettl entitled "Method for Operating a Pop-Up Cleaning Nozzle for a Pool or Spa," application Ser. No. 10/930,494, filed Aug. 31, 2004, now pending, which is a divisional application of a patent application to Goettl entitled "Cam Operated Pop-Up Swimming Pool Cleaning Nozzle filed Apr. 3, 2003, application Ser. No. 10/406,333, now U.S. Pat. No. 6,848,124, issued Feb. 1, 2005, the disclosures of which are hereby incorporated entirely herein by reference.

BACKGROUND

1. Technical Field

Aspects of this document relate generally to cleaning nozzles for swimming pools.

2. Background Art

Conventional cleaning nozzles for swimming pools utilize water pressure generated by a pool pump to direct a stream of water across a surface of the pool to entrain and move contaminants from the surface toward a drain. Many conventional cleaning nozzles "pop up" from a surface of a pool as the heads, normally level with the surface, are extended under the influence of water pressure from the pump. When the water pressure from the pump ends, the heads retract downward until level with the surface, conventionally in response to bias from a spring element contained within the cleaning nozzle.

SUMMARY

Implementations of a swimming pool cleaning head may utilize methods of cleaning a swimming pool. A first method may include the steps of intermittently raising a nozzle head and ejecting a stream of water under water, incrementally rotating the nozzle head in a clockwise direction, retracting the nozzle head, sliding a cam reverser, and reversing the direction of rotation of the nozzle head with the cam reverser to counterclockwise.

The first method may also include one, all, or some of the following:

Incrementally rotating the nozzle head in the counterclockwise direction, sliding the cam reverser, and reversing the direction of rotation of the nozzle head to clockwise.

Repeating the steps of incremental rotation of the nozzle head in the clockwise or counterclockwise direction, sliding of the cam reverser, and reversing of the direction of rotation of the nozzle head for a predetermined interval of time.

Repeating the steps of incremental rotation of the nozzle head in the clockwise or counterclockwise direction, sliding of the cam reverser, and reversing of the direction of rotation of the nozzle head according to a predefined pattern.

A second method of cleaning a swimming pool with a pool cleaning head may include the steps of rotating a stem by sliding at least one pin coupled to the stem through at least one channel in a cam, the stem configured to release a stream of water under water in a swimming pool. The method may further include the step of reversing the direction of rotation of the stem by sliding a slidable section of the cam with the at least one pin.

The second method may include one, all, or some of the following:

The at least one pin may slide through the at least one channel, wherein the at least one channel is a first channel, when the stem is raised upward through water pressure force.

The at least one pin may slide through a second channel when the stem is retracted downward into a housing through bias from a spring element.

The raising and retraction of the stem may be repeated for a predetermined number of steps.

A slidable section of the cam may be slid as the at least one pin reaches a predetermined limit within the cam.

A third method of cleaning a swimming pool with a pool cleaning head may include the steps of extending a stem with water pressure force, rotating the stem by sliding at least one pin coupled to the stem through a first channel in a cam, and releasing a stream of water under water in a swimming pool. The method may further include the steps of retracting the stem through bias from a spring element, rotating the stem by sliding the at least one pin coupled to the stem through a second channel in the cam and repeating the steps of extending and retracting the stem a predetermined number of times. The method may also include the steps of reaching a predetermined limit within the cam and sliding a slidable section within the cam with the pin to reverse the direction of rotation of the stem.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended nozzle assembly and/or assembly procedures for a nozzle assembly will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such nozzle assemblies and implementing components, consistent with the intended operation.

Figure 1:
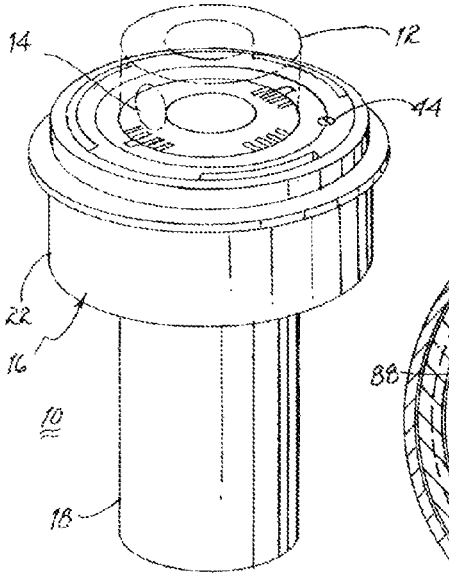
FIG. 1 is an perspective view of a nozzle assembly.

A particular implementation of a recessed incrementally rotating nozzle assembly 10 for use in swimming pools and the like is illustrated in FIG. 1. In the retracted position, the upper surface of the nozzle assembly is substantially flush with the adjacent swimming pool surface. The extended position of nozzle housing 12 is shown in dashed lines and includes an outlet 14 through which a stream of water is ejected. Body 16 includes a hollow cylinder 18 for attachment to the interior of a conduit 20 (see FIG. 2) periodically supplying water under pressure to the nozzle assembly.

A diametrically enlarged section 22 is supported by and extends from cylinder 18. Referring to the implementation illustrated in FIG. 2, cylinder 18 includes a plurality of lugs 30 disposed on the interior surface thereof. A retainer 32, for retaining the operative elements of the nozzle assembly within body 16, includes a plurality of lugs 34 extending radially outwardly for locking engagement with lugs 30 upon passing the lugs 34 of the retainer 32 axially past the lugs 30 of cylinder 18 and rotating the retainer 32 to bring about locking engagement. In particular implementations, an O-ring 36 or the like may be disposed between the retainer and the cylinder to prevent water flow therebetween.

A cam ring 40 is rotatably lodged within radially expanded section 42 of retainer 32. Rotation of the cam ring 40 relative to section 42 is prevented by a screw 44, or the like, threadedly inserted between cam ring 40 and section 42. A plurality of downwardly pointing saw tooth members 46 are disposed along the upper part of cam ring 40. A similar plurality of upwardly pointing saw tooth members 48 are disposed along cam ring 40. A ring-like cam reverser 50 is slidably lodged adjacent cam ring 40 and is circumferentially slidably captured between saw tooth members 46, 48. An arm 52 extends downwardly and radially inwardly from the cam reverser 50. Further details relating to the structure and operation of implementations of the saw tooth members 46, 48, the cam reverser 50, and the arm 52 will be described later in greater detail.

A sleeve 60 is vertically translatable upwardly within cylinder 18 in response to water pressure present within conduit 20. Such vertical translation is resisted by a coil spring 62 bearing against an annular lip 64 of the sleeve 60, a lip 81 associated with a pattern cam 80, and the retainer 32. Nozzle housing 12 is supported upon sleeve 60 and defines an outlet 14 through which a stream of water is ejected upon upward translation of the sleeve 60. In the absence of water pressure within conduit 20, coil spring 62 will draw sleeve 60 and nozzle assembly 12 downwardly to the retracted position illustrated in FIG. 2. A pair of diametrically opposed pins 70,72 extend radially outwardly from nozzle housing 12 for sliding engagement with sets of saw tooth members 46, 48, which engagement causes nozzle housing 12 to rotate incrementally each time it is extended and refracted under the influence of water pressure, as will be described in further detail below.

A pattern cam 80 is positionally fixed upon radially extending shoulder 38 formed as part of retainer 32. It includes lip 81 extending around the interior edge of shoulder 38. The pattern cam 80 is configured to determine the angular extent of reciprocating rotation of nozzle housing 12. Particular implementations of a pattern cam 80 may define an angle of reciprocating rotation of 180 degrees or ninety degrees; however, for implementations utilized in specific locations within a swimming pool, a greater or lesser angle of reciprocating rotation may be selected to ensure washing/scrubbing of the swimming pool surface of interest.

Figure 3:
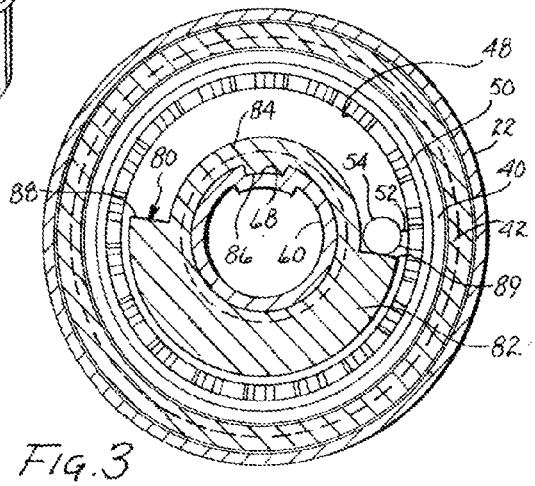
FIG. 3 is a cross sectional view taken along lines 3-3 shown in FIG. 2.
Figures 6, 6A:
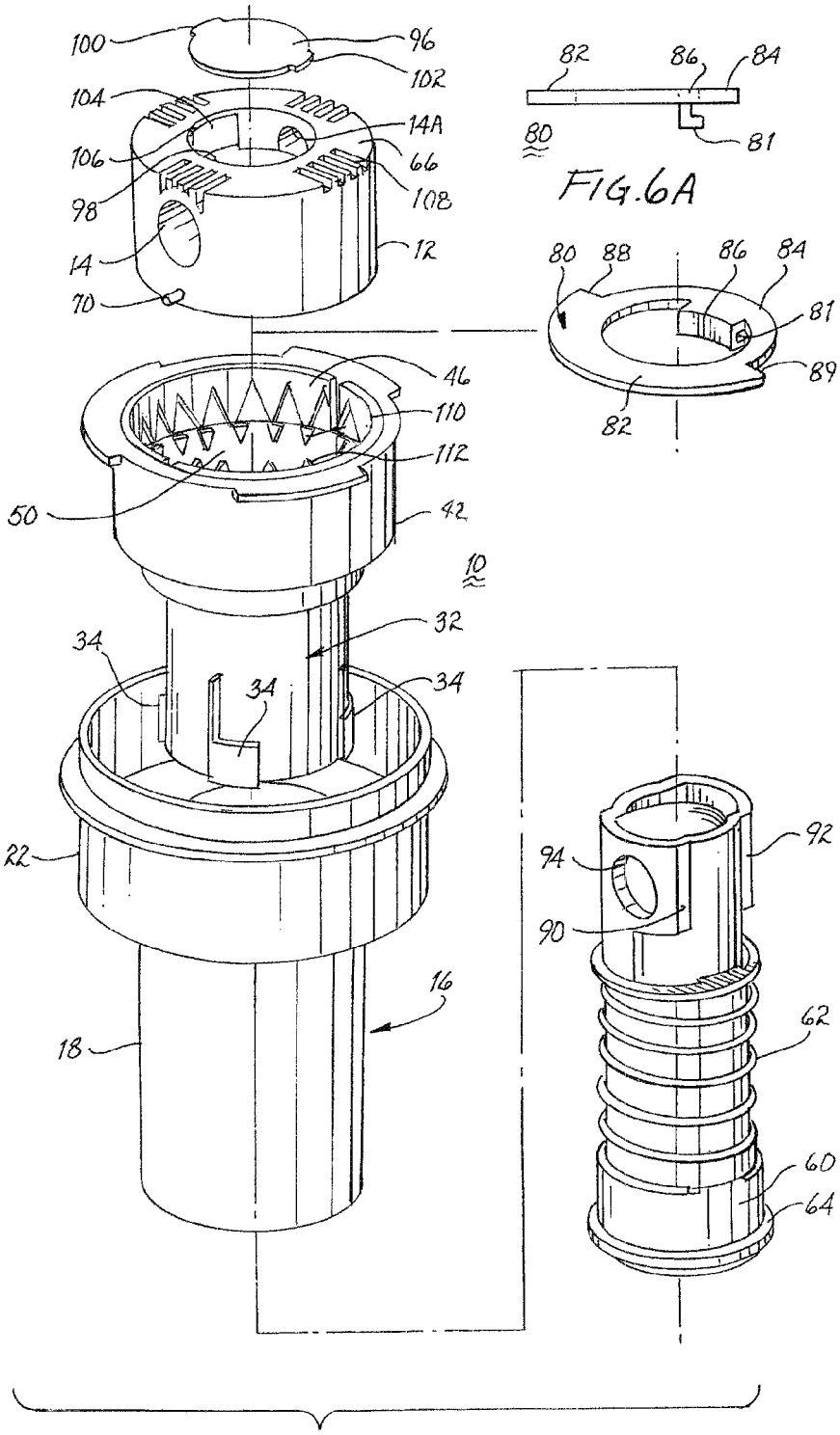
FIG. 6 is an exploded view of a nozzle assembly.
FIG. 6A is a side view of the pattern come shown in FIG. 6.

Referring to FIGS. 3, 6 and 6A, an implementation of a pattern cam 80 is illustrated. Sleeve 60 includes a keyway 68 to serve in the manner of an index. Pattern cam 80 includes an annular arc 84 extending from semi-circular disc 82, the combination of which surrounds sleeve 60. Annular arc 84 includes a key 86 mating with keyway 68 of sleeve 60; thereby, the pattern cam 80 is indexed with the sleeve 60 and will rotate commensurate with nozzle housing 12, also fixedly attached to the sleeve. Arm 52 is terminated by a flat roundel 54 disposed in the horizontal plane of disc 82. As sleeve 60 rotates in response to pins 70, 72 sequentially contacting saw tooth members 46, 48, pattern cam 80 will rotate commensurately. When one of edges 88, 89 of disc 82, such as edge 89, contacts roundel 54 as the disc rotates in, for instance, a counterclockwise direction as viewed in FIG. 3, the force of edge 89 acting upon roundel 54 will cause the roundel 54, arm 52, and cam reverser 50 to be repositioned incrementally counter clockwise as a function of the spacing between adjacent saw tooth members 46,48 (see FIG. 2). The resulting repositioning of the cam reverser results in a change in direction of rotation of sleeve 60 along with attached nozzle housing 12. On the completion of incremental steps of rotation in the counter clockwise direction, edge 88 of disc 82 will contact the other side of roundel 54 and cause it to be translated incrementally clockwise. Such translation of the roundel 54 is translated via arm 52 to cam reverser 50 and the rotation of sleeve 60 and nozzle housing 12 will change direction.

Figure 4:
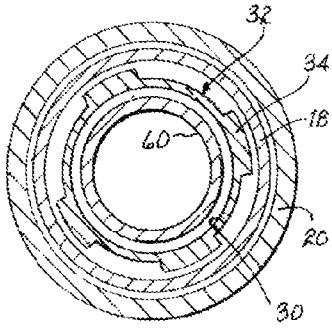
FIG. 4 is a cross sectional view taken along lines 4-4 shown in FIG. 2.

FIG. 4 primarily illustrates lugs 34 of retainer 32 in engagement with lugs 30 of cylinder 18, all of which are disposed within conduit 20.

Figure 2:
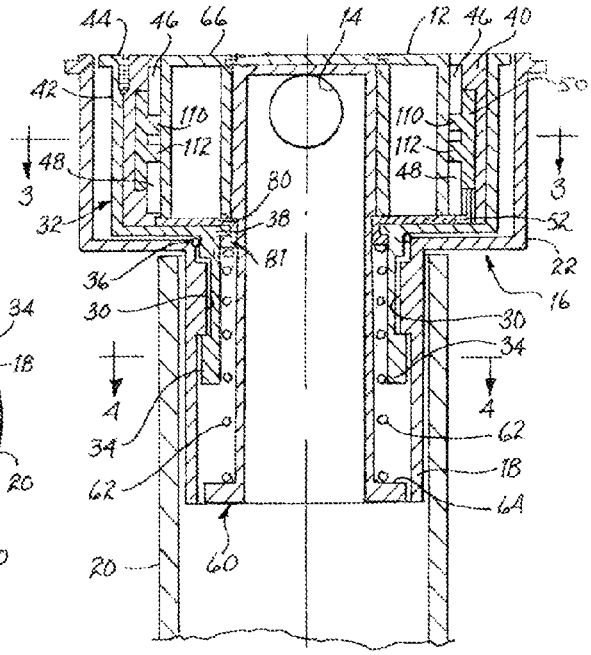
FIG. 2 is a cross sectional view of the nozzle assembly shown in the retracted position.
Figure 5:
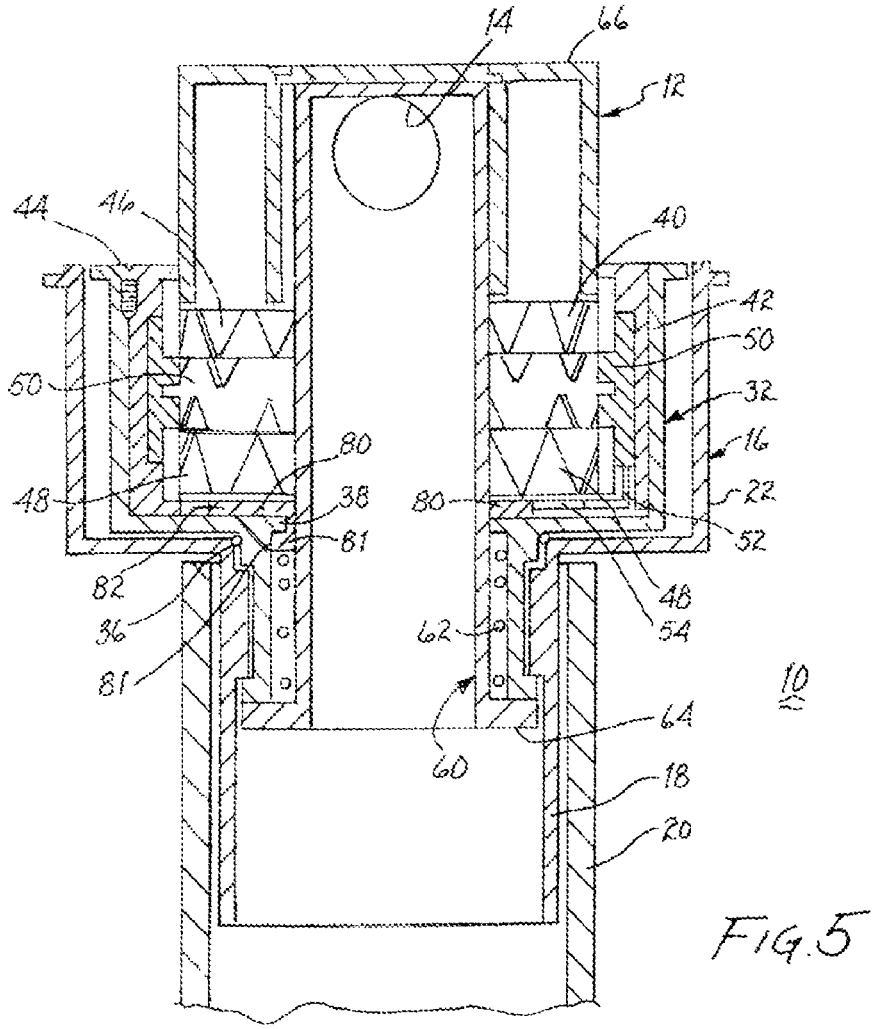
FIG. 5 is a cross sectional view of the nozzle assembly in the extended position.

FIG. 5 illustrates a particular implementation of a nozzle housing 12 in the extended position. In this condition, water pressure exists within conduit 20 and causes sleeve 60 to be raised against the bias supplied by coil spring 62. As the sleeve 60 rises, it causes nozzle housing 12 to rise, as illustrated. As the nozzle housing 12 rises, pins 70, 72 rise in the spaces formed by the edges of intermediate saw tooth members 46. Because the pins 70,72 bear against the edges of saw tooth members 46, which are slanted opposed sides, the pins 70,72 are angularly translated about the vertical axis of nozzle 10, rotating nozzle housing 12 incrementally a corresponding angular distance. When water pressure within conduit 20 is terminated, the bias supplied by coil spring 62 will cause sleeve 60 to retract and the nozzle housing 12 will be lowered within section 22, as shown in FIGS. 1 and 2. As nozzle housing 12 is lowered, pins 70, 72 contact the edges of saw tooth members 48 and angularly translate once again, rotating the nozzle housing 12 incrementally a corresponding angular distance. The direction of rotation (clockwise or counterclockwise) is controlled by cam reverser 50 and will be described in further detail with reference to FIGS. 7 and 8.

FIG. 6 illustrates an exploded view of the primary components of a particular implementation of a nozzle assembly 10 and FIG. 6A illustrates an implementation of a pattern cam 80 in more detail. As illustrated, sleeve 60 may include lugs 90, 92 cooperating with corresponding lugs in nozzle housing 12 to function similarly to a bayonet fitting and lock the sleeve 60 with the housing 12. Upon locking, the outlet 94 of the sleeve 60 may be oriented with either of diametrically opposed outlets 14, 14A in nozzle housing 12.

A disc 96 may be centrally located in the top of the nozzle housing 12 to close opening 98, that is formed primarily for manufacturing purposes. The disc 96 may include opposed lugs 100, 102 which slidably engage corresponding opposed slots, of which slot 104 is shown. A lip 106 is disposed at the top of each of the slots 104 to prevent ejection of disc 96. The four sets of channels 108 illustrated in the particular implementation of a nozzle housing 12 may have no functional purpose and may be employed primarily for manufacturing reasons to minimize the thickness of the plastic of the nozzle housing and avoid shrinkage after manufacture. In the implementation illustrated, pattern cam 80 includes a disc 82 representing approximately 180 degrees between edges 88, 89, which disc controls the angular excursion of nozzle housing 12. However, the angular excursion can be easily reduced to 90 degrees or set to any other value by simply substituting another pattern cam 80 having an annular extension such that the angular distance between edges 88, 89 corresponds with the angular rotation wanted of for the nozzle housing 12.

Figures 7, 8:
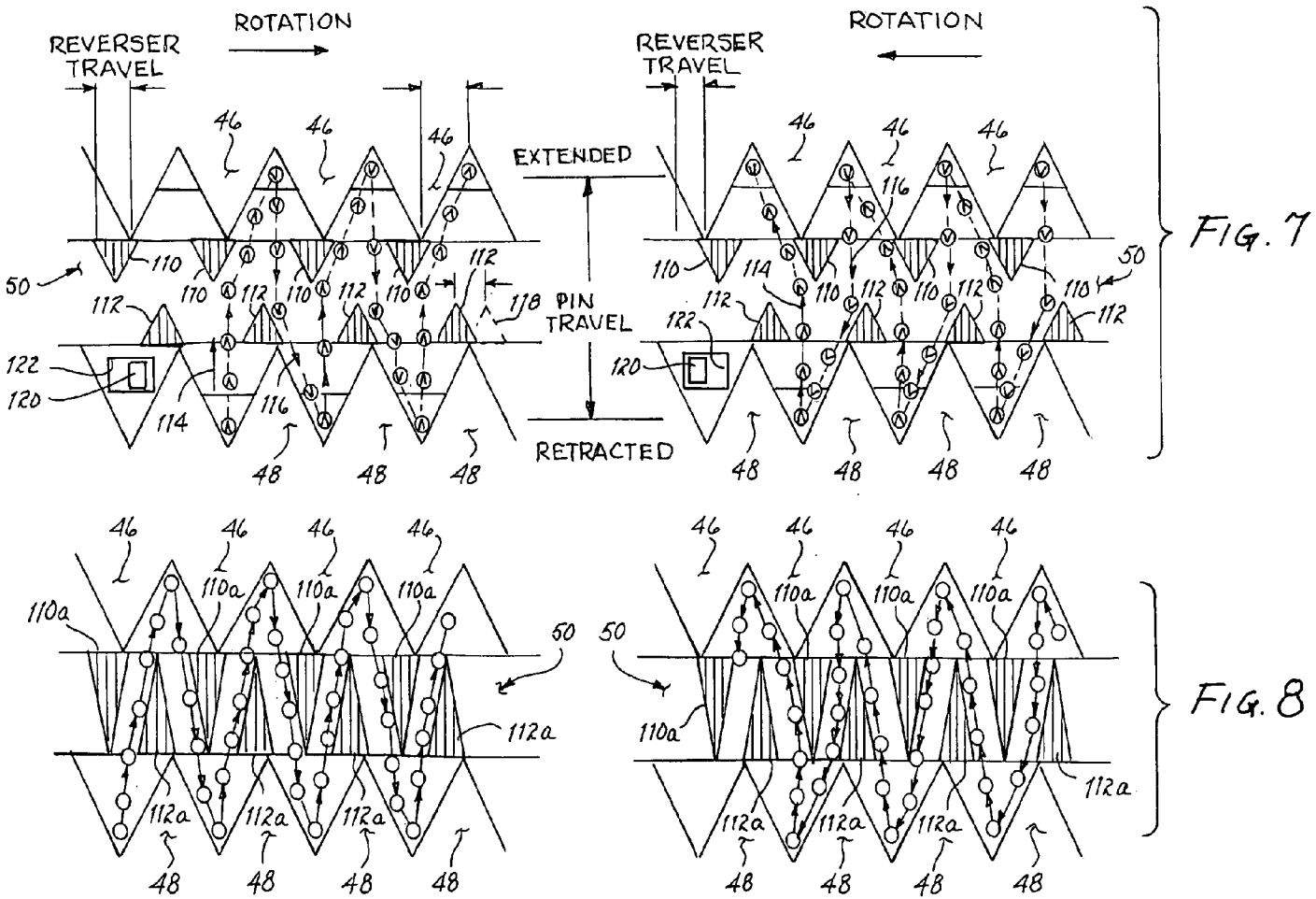
FIG. 7 illustrates the travel path of a pin through the cam while incrementally rotating the nozzle assembly.
FIG. 8 illustrates the travel path of the pin through an alternative cam while incrementally rotating the nozzle assembly.

Referring to FIG. 7, the incremental rotation, automatic reversal, and subsequent incremental rotation of a particular implementation of a nozzle housing 12 is illustrated. Saw tooth members 46, located on cam ring 40, are representatively illustrated along with saw tooth members 48 also mounted upon the cam ring 40. Cam reverser 50 includes a series of upper triangularly shaped protrusions 110 pointed downwardly (see also FIG. 2) and a plurality of lower triangularly shaped protrusions 112. One of pins 70, 72 is represented by a roundel having therein either a symbol of V or A. The symbol V represents downward movement of the pin and the symbol A represents upward movement of the pin. When sleeve 60 is forced upwardly by water pressure within conduit 20, nozzle housing 12 and pins 70, 72 extending therefrom will travel upwardly, as represented by arrow 114, from in-between the junction of two adjacent saw tooth members 48, as depicted on the left side of FIG. 7.

Upon upward movement, the pin(s) 70, 72 will strike protrusion 110 and be deflected to the right, or in the clockwise direction, as indicated. Such deflection will incrementally rotate nozzle housing 12 clockwise. After the pin(s) 70, 72 passes protrusion 110, it will be guided to the right by the edge of saw tooth member 46 until it reaches the junction between adjacent saw tooth members 46. In particular implementations, the degree of rotation of nozzle housing 12 may be commensurate with the angular distance between the junction between adjacent saw tooth members 48 and the junction between adjacent saw tooth members 46. After water pressure within conduit 20 ceases, coil spring 62 causes retraction of sleeve 60 and nozzle housing 12. During such retraction, the pin(s) 70,72 moves vertically downwardly, as represented by arrow 116, until it strikes an edge of protrusion 112. This protrusion 112 will guide the pin 70,72 adjacent an edge of saw tooth members 48 until it comes to rest at the junction between the two adjacent saw tooth members 48.

In particular implementations, saw tooth members 46 may be offset from saw tooth members 48 by one-half of the width of the saw tooth members 46, 48, when saw tooth members 46, 48 have substantially identical dimensions. In other particular implementations, the degree of rotation of the nozzle housing 12 during each incremental rotation step may be governed by the dissimilarly between the relative dimensions of the saw tooth members 46, 48, e.g., the nozzle housing 12 may rotate more on its way down rather than on its way up.

As nozzle housing 12 rotates, sleeve 60 will rotate commensurately. Such rotation of the sleeve will cause pattern cam 80 (see FIG. 3) to rotate until one of edges 88, 89 contacts roundel 54 and causes the roundel 54 to move angularly. Such angular movement of roundel 54 is translated to commensurate rotational (angular) movement of cam reverser 50. The angular displacement of the cam reverser 50 is depicted and represented by protrusion 118 shown in dashed lines to indicate movement of each of protrusions 112 (and protrusions 110). The resulting relationship between protrusions 110, 112 and saw tooth members 46, 48 is depicted in the right half of FIG. 7.

As illustrated, the pin(s) 70, 72 will move upwardly from in between saw tooth members 48 commensurate with upward movement of nozzle housing 12 upon the presence of water pressure within conduit 20. As the pin 70, 72 moves upwardly, it will contact protrusion 110 and be directed to the left, or counterclockwise, (not to the right as formerly described). Thereafter, the pin(s) 70, 72 will slide along the edge of saw tooth members 46 until reaching the junction between adjacent saw tooth members 46. Upon cessation of water pressure within conduit 20, sleeve 60 and nozzle housing 12 will retract and the pin(s) 70, 72 will move until it strikes the edge of protrusion 112. This edge will guide the pin(s) 70, 72 onto the edge of a saw tooth member 48 until it bottoms out at the junction between adjacent saw tooth members 48; this position corresponds with the retracted position of sleeve 60 and nozzle housing 12. The resulting incremental rotation of nozzle housing 12 will continue until the other edge of cam pattern 80 contacts and causes rotational movement of roundel 54 to relocate the cam reverser 50.

To limit the rotational movement of cam reverser 50, a tab 120 extends from retainer 32 into penetrable engagement with a slot 122 formed in cam reverser 50. The movement of the slot 122 with respect to the tab 120 controls the degree of angular excursion of the cam reverser 50 each time the rotational movement is changed; furthermore, the movement of the slot 122 from one side to the other precisely controls the repositioning of protrusions 110, 112 to ensure alignment with the respective saw tooth members 46, 48 and thereby accurately directs the engaging pin 70,72 to the corresponding edge of the respective saw tooth member 46, 48.

Referring to FIG. 8, another particular implementation of saw tooth members and protrusions 110A and 112A is illustrated. Protrusions 110A and 112A are generally adjacent one another whereby the tip of one protrusion 110A, 112A is essentially horizontally aligned with the base of an adjacent protrusion 110A, 112A. Such arrangement may provide a greater degree of guidance for the pin(s) 70, 72 as they move up and down adjacent the protrusions 110A, 112A and into the junctions between upper and lower adjacent saw tooth members. Other than these structural distinctions, implementations like those illustrated in FIG. 8 function and operate similarly to those illustrated and described with reference to FIG. 7.

It may be noted that the degree of total angular rotation of nozzle housing 12 is, as stated above, a function of the angular extent of disc 82 between edges 88, 89 of pattern cam 80. To change the degree of total angular rotation excursion of nozzle housing 12, an existing pattern cam 80 may be readily substituted with another pattern cam having an angularly differently configured disc 82 to increase or decrease the amount of total angular rotation of the nozzle housing 12.

In the past, the orientation of a stream of water emanating from a nozzle was set by carefully aligning the nozzle assembly as a whole in the desired direction. Such alignment was generally semi-permanent and adjustment was usually quite difficult. Because of such difficulty, workmen tended to have the attitude that "close enough was good enough". Unfortunately, the cleaning capability was usually compromised. With implementations of nozzle assemblies 10, adjustment can be more readily and easily made by loosening screw 44 (see FIGS. 1 and 2) and rotating cam ring 40 until the water stream is ejected precisely to the area of interest. To set the cam ring 40 in this new position, screw 44 is tightened.

Structure.

Figure 9:
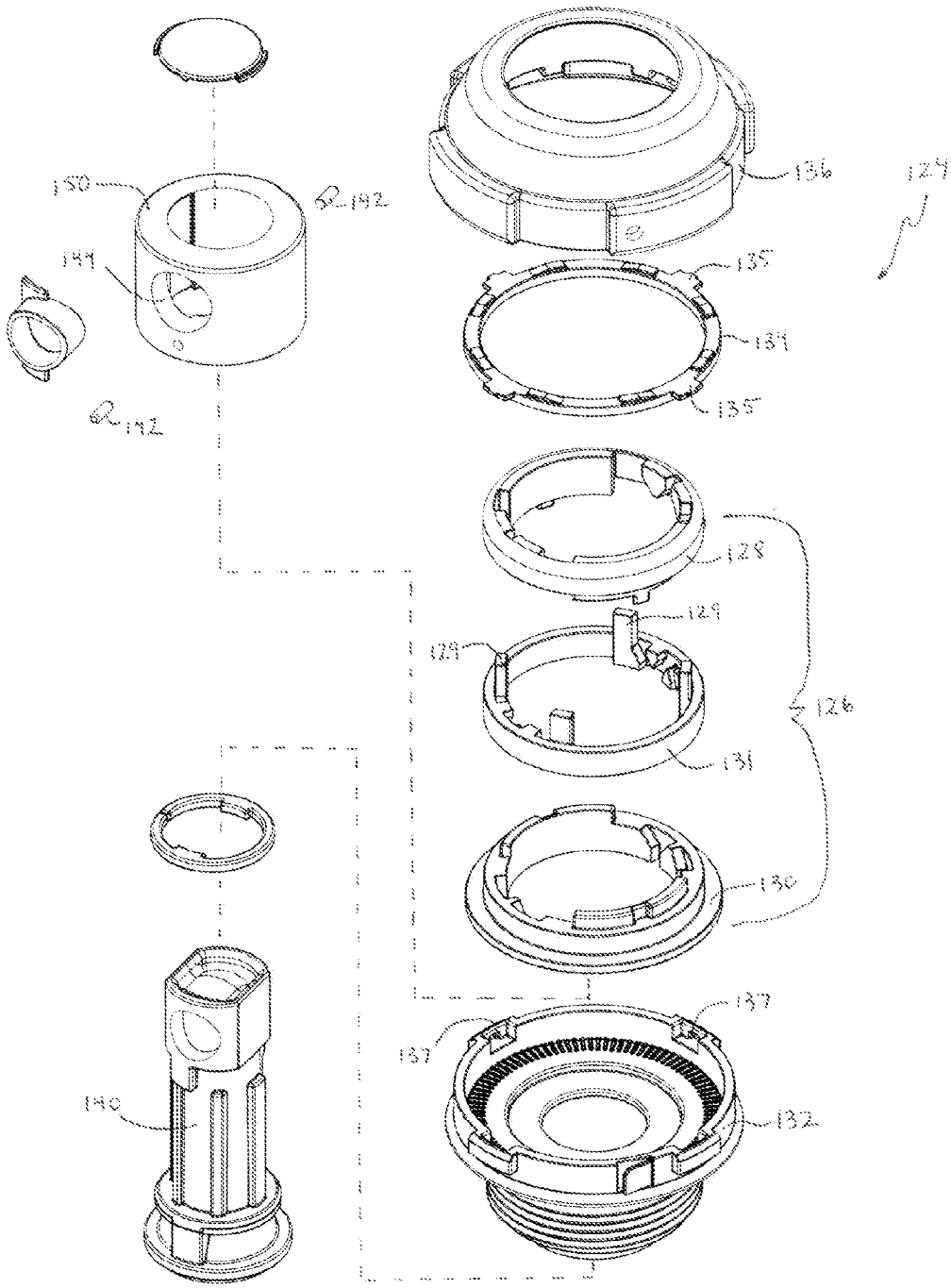
FIG. 9 is an exploded view of an implementation of a nozzle assembly.

Referring to FIG. 9, an exploded view of another implementation of a cleaning head assembly (alternatively called a nozzle assembly) 124 is illustrated. The cleaning head assembly 124 may include a cam assembly (alternatively called a cam ring) 126. As illustrated, in particular implementations the cam assembly 126 may include an upper section 128, a slidable section 131 (alternatively called a cam reverser), and a lower section 130. The slidable section 131 may include at least one shifter 129 that extends from the slidable section into the upper section 128. The cam assembly 126 may couple into a housing (alternatively called a body) 132. When coupled into the housing 132, a locking ring 134 may be coupled over the lower section 130 and includes lugs 135 that engage within locking features 137 in the housing 132. In particular implementations, the upper section 128 and lower section 130 of the cam assembly 126 may be fixedly coupled together through, by non-limiting example, a sonic weld, heat staking, adhesive or other method of fixedly coupling two plastic parts together. While the upper section 128 and lower section 130 are fixedly coupled together, the slidable section 131 remains slidably engaged between them and is free to move rotatably with respect to the upper and lower sections 128, 130, respectively.

A cap ring 136 may be coupled over the cam assembly 126 against the locking ring 134. Use of the cap ring 136 may allow, in particular implementations, for the lower and upper sections 130, 128 of the cam assembly 126 to be rendered substantially immobile in relation to the housing 132 during operation of the cleaning head assembly 124 while leaving the slidable section 131 capable of rotational sliding motion.

Figure 10:
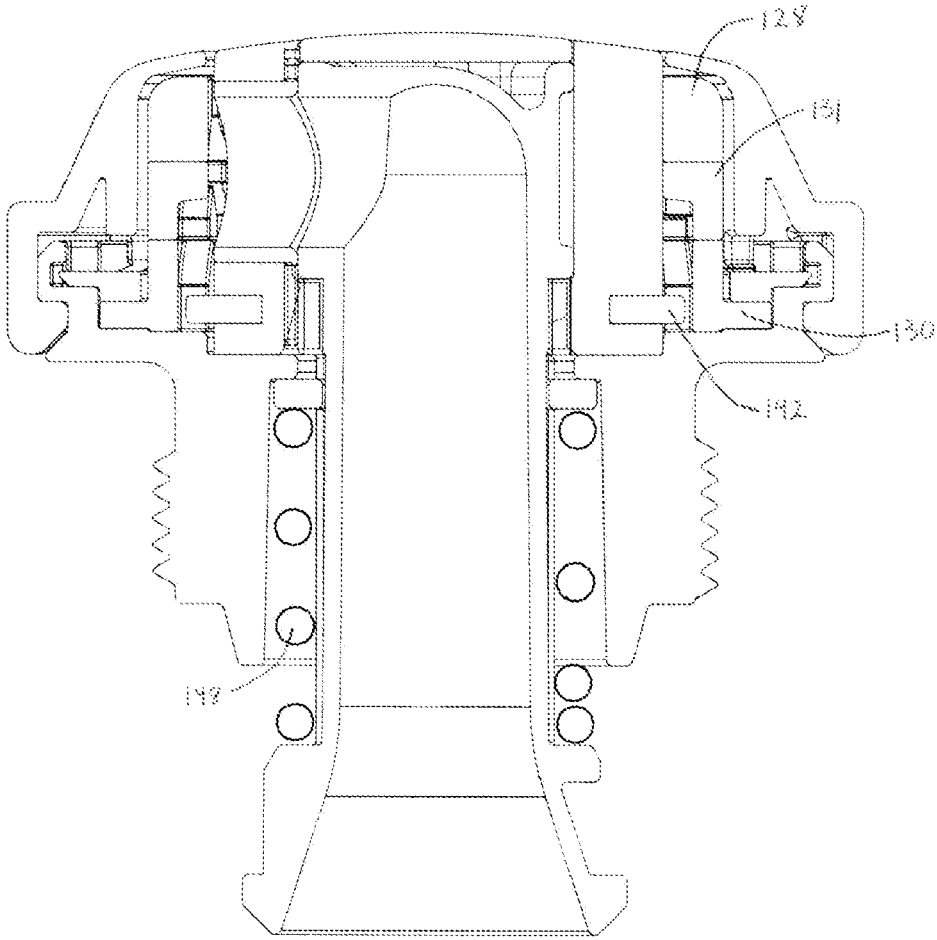
FIG. 10 is a cross sectional view of an assembled nozzle assembly along sectional line A in FIG. 9.

As illustrated in FIG. 9, implementations of a cleaning head assembly 124 may include a stem (sleeve) 140 that extends through the housing 132 and the cam assembly 126. In the particular implementation illustrated in FIG. 9, the stem comprises at least one pin 142 that extends from a side of a head 150 (nozzle housing) that couples over the top of the stem 140. In other implementations, the at least one pin 142 may couple to other components associated with the stem 140 so that in either case (whether extending from the side of the head 150 or from some other component associated with the stem 140 or from the stem directly), the at least one pin 142 can be said to extend from the stem 140. In particular implementations of a stem 140, two or more pins 142 may be included, and the relation between the direction the pin 142 extends from the side of the stem 140 relative to the outlet 144 may range from about parallel to about perpendicular, depending upon system requirements. The pin 142 for these implementations engages with the cam assembly 124 within the upper section 128, the slidable section 131, and the lower section 130, as illustrated in FIG. 10. In particular implementations, the pin 142 may be engaged against the edges of a plurality of saw teeth 146 within the cam assembly 126. The stem 140 may further include a spring element (coil spring) 148 (shown on FIG. 10) configured to provide bias force against the stem 140 when it is extended from the housing 132.

Use.

Figure 11:
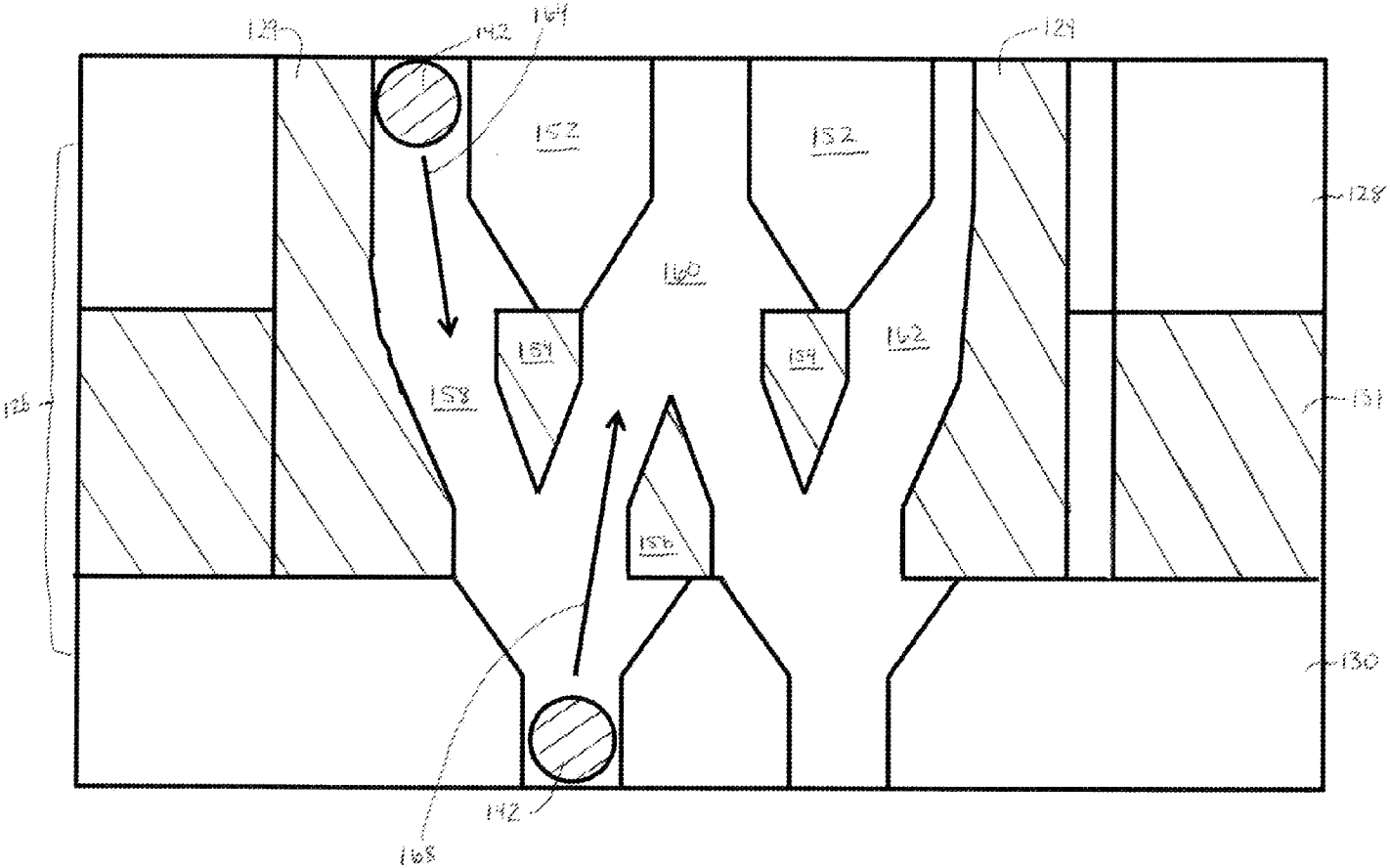
FIG. 11 illustrates the travel path of a pin through the cam of an implementation of a nozzle assembly during intermittent rotation clockwise.

Referring to FIG. 11, an illustration of the interior of a cam assembly (example as cam assembly 126 in FIG. 9) for a cleaning head assembly (example as cleaning head assembly 124 in FIG. 9) is shown with reference to the particular implementation of FIG. 9 as an example. As illustrated, the edges of the saw teeth 152, 154, 156 of the upper section 128 and slidable section 131 of the cam assembly 126 form a plurality of channels 158, 160, 162 in which a pin 142 travels during operation of a cleaning head assembly 124. For ease of understanding, slidable section 131 has been marked in FIGS. 11 and 12 with right downwardly sloping hatch marks. The pin 142 has been marked with right upwardly sloping hatch marks. Although the FIGs. Show more than one pin 142, this is intended to be illustrative of the movement of the pin 142 from one end of a channel to another end and not necessarily that there are two pins 142 in the particular implementation.

During operation of the cleaning head assembly, water pressure force is intermittently exerted on the stem 140, forcing it to extend upwardly. As the stem 140 moves upwardly, the pin 142 also travels upwardly in a first channel 158 formed to a side of the edges of the saw teeth 152, 154. When the water pressure force is removed, the bias of the spring element 148 withdraws the stem 140 into the housing 132 (see FIG. 9). As the stem 140 withdraws, the pin 142 travels downwardly through the first channel 158 (as indicated by the arrow 164). In the process, the rotational position of the stem 140 may travel incrementally clockwise (or counterclockwise depending upon the direction of movement for the stem). When the intermittent water pressure force is once again exerted on the stem 140, the pin 142 travels upwardly between the saw teeth 154, 156 into the second channel 160, as indicated by the arrow 168. Once again, the rotational position of the stem 140 may continue to move incrementally clockwise (or counterclockwise).

Figure 12:
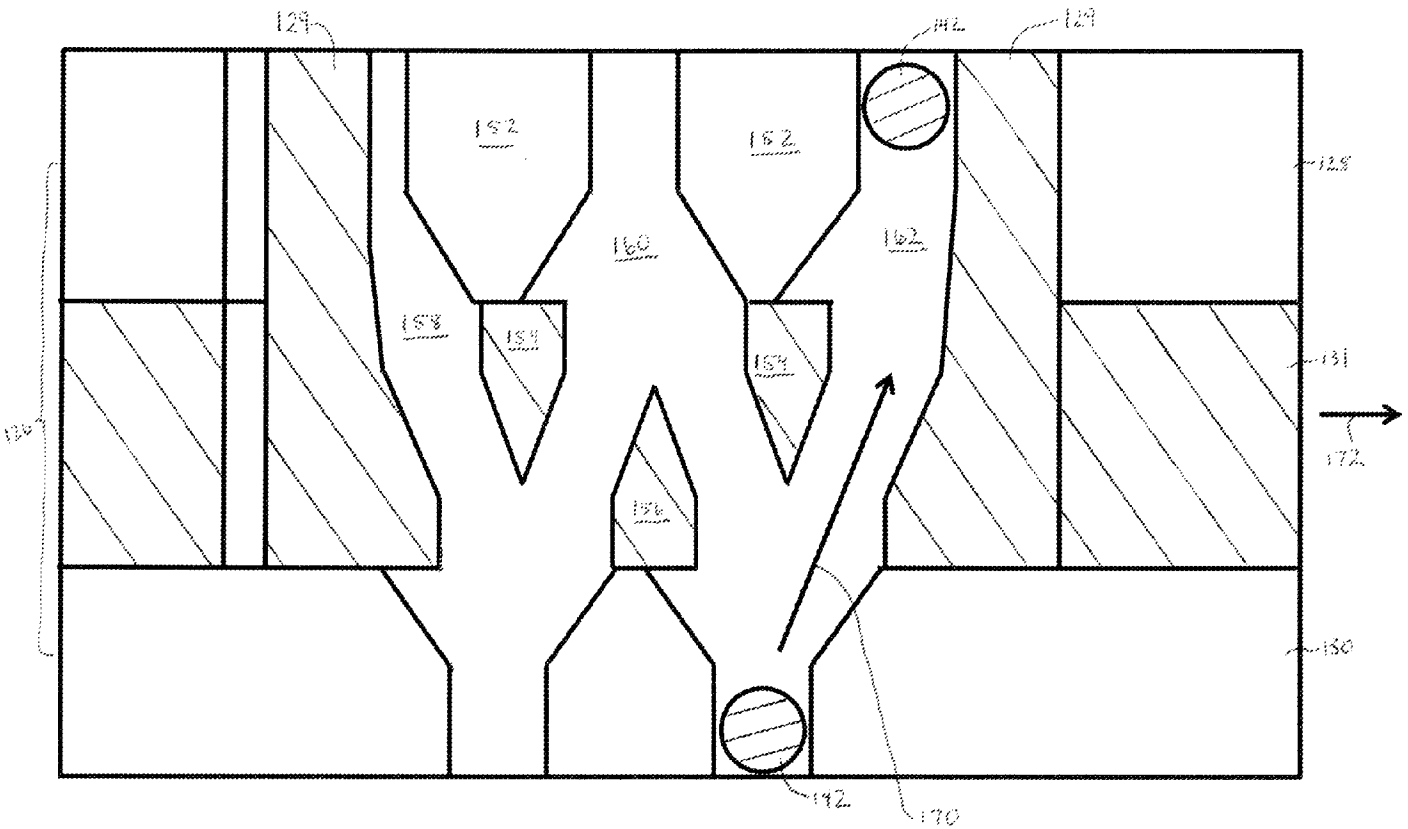
FIG. 12 illustrates the travel path of a pin through the cam of an implementation of a nozzle assembly indicating the movement of the slidable section of the cam followed by intermittent rotation counterclockwise

Referring to FIG. 12, as the water pressure force is again removed from the stem 140, the bias of the spring element 148 draws the stem 140 (see FIG. 9) downward again, causing the pin 142 to travel between saw teeth 156, 154, further moving the rotational position of the stem 140 incrementally clockwise (or counterclockwise). By repeating the intermittent application and removal of water pressure force, stem 140 rotate until the pin 142 enters the third channel 162, as indicated by arrow 170. The top of channel 162 is originally narrower than the diameter of the pin 142 (see FIG. 11 for its earlier position). As the pin 142 enters channel 162 under water pressure force as indicated by arrow 170, the pin 142 presses against the edge of saw tooth 152 and against shifter 129, moving the shifter 129 and inducing slidable rotation of the slidable section 131 in relation to the upper and lower cam sections 128 and 130, and a widening of channel 162 to allow the pin 142 to fully enter channel 162. Arrow 172 in FIG. 12 shows the direction of rotation of the slidable section 131 in relation to the remainder of the cam assembly 126. As channel 162 widens through rotational movement of the shifter 129 coupled to the slidable section 131 of the cam assembly, the width of channel 158 is reduced (see FIG. 12 as compared with FIG. 11). When the pin 142 reaches channel 162 and completes widening it, the cleaning head assembly 124 (FIG. 9) has reached a first limit position or a predetermined limit after completing a predetermined number of rotational steps and is no longer able to rotate further in the clockwise direction.

When the water pressure force is removed from the stem 140, the pin 142 travels back down channel 162. As the pin 142 does so, the angular position of the stem 140 begins to be incrementally and/or automatically adjusted in the counterclockwise direction just like it was previously in the clockwise direction. Under the influence of the intermittent water pressure force, and through the action of the engagement of the pin 142 within the cam assembly 126, the angular position of the stem 140 continues to incrementally travel in the counterclockwise direction until the pin 142 slidably rotates the slidable section 131 back by entering and widening channel 158, or through reaching a second limit position or predetermined limit. Through automatic positioning and reversal of the pin movement within the predetermined limits of the cam assembly, the cleaning head assembly automatically begins another cycle of movement in the clockwise direction after completion of a predetermined number of rotational steps. The ability of the slidable section 131 to slidably rotate with respect to the lower and upper sections 130, 128 enables the automatic reversal of the direction of rotation of particular implementations of cleaning head assemblies 124.

While the implementation of a cam assembly 126 illustrated in FIGS. 11 and 12 comprise only a few saw teeth 152, 154, 156, and three channels 158, 160 and 162, in other particular implementations, any number of saw teeth and corresponding channels may be employed. Such implementations may, therefore, incorporate smaller or larger rotational increments (steps), be evenly spaced or unevenly spaced, and/or incorporate a wider or shorter range of rotational movement before automatically reversing direction. For example, the saw teeth 152, 154, 156 may be spaced any distance apart to increase or decrease the stepwise rotational distance the stem 140 turns as water pressure force is intermittently applied. In addition, the degree of rotation of the stem 140 allowed by the number of saw teeth 152, 154, 156 employed may range in particular implementations from substantially 360 degrees to substantially 0 degrees, depending upon the desired location and function of the cleaning head assembly 124. Also, in particular implementations, the relative sizes of the saw teeth 152, 154, 156 and/or angles of the channels 158, 160, 162 may be varied to allow the stem 140 to rotate a greater angular distance during certain rotational cycles than in others. Implementations employing regularly sized and spaced saw teeth 152, 154, 156 may employ a method of cleaning a pool floor that includes rotating the position of the stem 140 a certain predetermined distance within a predetermined or irregular interval of time. In implementations employing irregularly sized and/or spaced saw teeth 152, 154, 156, the method may employ rotating the position of the stem 140 according to a predefined pattern during a predetermined or irregular interval of time.

Figure 13:
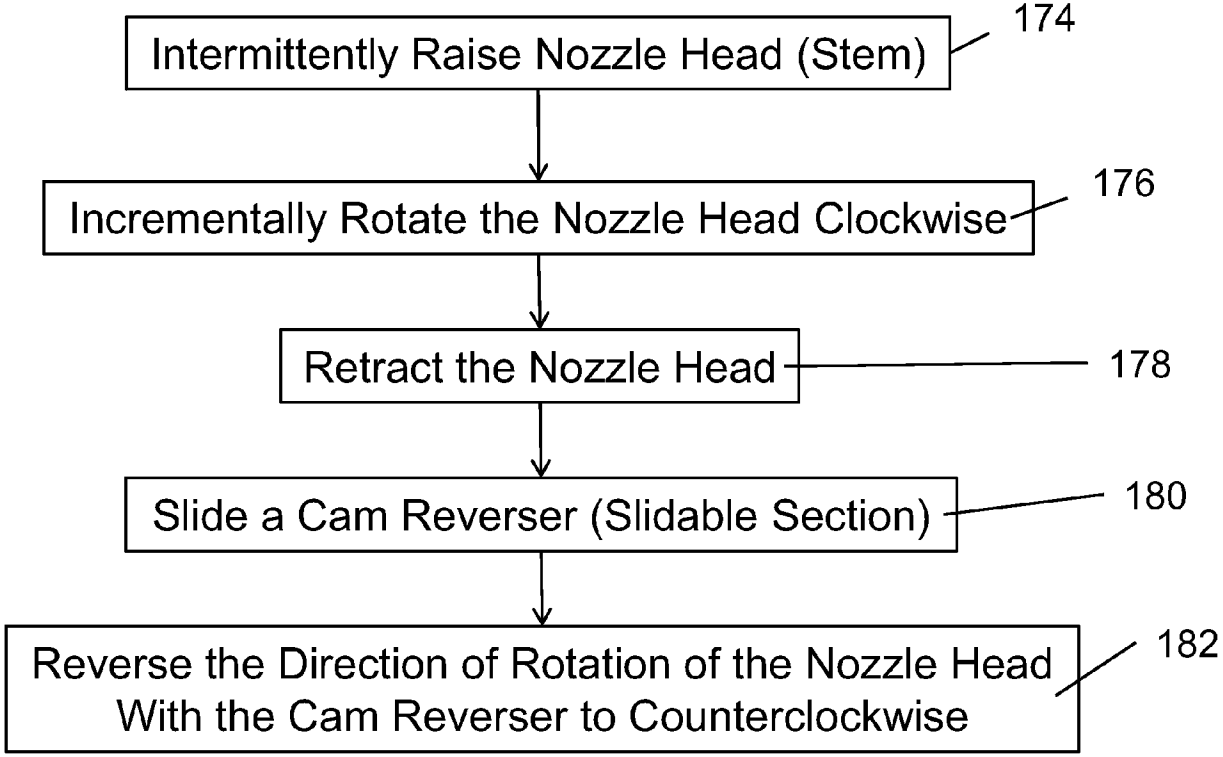
FIG. 13 is a flow diagram of the steps of a method of cleaning a swimming pool utilized by particular implementations of swimming pool cleaning heads.

Referring to FIG. 13, a flowchart of method steps is illustrated. Implementations of a pool cleaning head may include a method of use that may include the steps of intermittently raising the nozzle head (stem, step 174), incrementally rotating the nozzle head clockwise (step 176), and retracting the nozzle head (step 178). In particular implementations, steps 174, 176, and 178 may be repeated multiple times, or may occur only once. Also, during the step of retracting the nozzle head (step 178), the nozzle head may also be incrementally rotated clockwise (step 176). As illustrated, method may also include the step of sliding a cam reverser (slidable section, step 180) and reversing the direction of rotation of the nozzle head with the cam reverser to counterclockwise (step 182). In particular implementations, these two steps may occur after a predetermined number of repetitions (cycles, or steps) of steps 174, 176 and 178, or may occur after just one occurrence of each of steps 174, 176, and 178. In implementations of a pool cleaning head, the sliding of the cam reverser (step 180) and the reversing of the direction of rotation of the nozzle head (step 182) may be repeated automatically (along with the repetitions of steps 174, 176, and 178) a predetermined number of times or according to a predefined pattern, allowing the pool cleaning head to incrementally and intermittently rotate through a particular arc of rotation or a fully 360 degrees for a desired period of time.

It will be understood that implementations are not limited to the specific components disclosed herein, as virtually any components consistent with the intended operation of a method and/or system implementation for a nozzle assembly may be utilized. Accordingly, for example, although particular nozzle assemblies may be disclosed, such components may comprise any shape, size, style, type, model, version, class, grade, measurement, concentration, material, weight, quantity, and/or the like consistent with the intended operation of a method and/or system implementation for a nozzle assembly may be used.

In places where the description above refers to particular implementations of nozzle assemblies, it should be readily apparent that a number of modifications may be made without departing from the spirit thereof and that these implementations may be applied to other nozzle assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A method of cleaning a swimming pool, the method comprising:

intermittently raising a nozzle head under water and ejecting a stream of water;

incrementally rotating the nozzle head in a clockwise direction;

retracting the nozzle head flush with an inner surface of the swimming pool;

sliding a cam reverser; and reversing the direction of rotation of the nozzle head with the cam reverser to counterclockwise.

2. The method of claim 1, further comprising the step of incrementally rotating the nozzle head in the counterclockwise direction, sliding the cam reverser, and reversing the direction of rotation of the nozzle head to clockwise.

3. The method of claim 2, further comprising repeating the steps of incrementally rotating the nozzle head in the clockwise or counterclockwise direction, sliding the cam reverser, and reversing the direction of rotation of the nozzle head for a predetermined interval of time.

4. The method of claim 2, further comprising repeating the steps of incrementally rotating the nozzle head in the clockwise or counterclockwise direction, sliding the cam reverser, and reversing the direction of rotation of the nozzle head according to a predefined pattern.

5. A method of cleaning a swimming pool with a pool cleaning head, the method comprising:

rotating a stem by sliding at least one pin coupled to the stem through at least one channel in a cam, the stem configured to release a stream of water under water in a swimming pool;

retracting the stem into the pool cleaning head such that the pool cleaning head is flush with an inner surface of the swimming pool; and reversing the direction of rotation of the stem by sliding a slidable section of the cam with the at least one pin.

6. The method of claim 5, wherein the at least one pin slides through the at least one channel when the stem is raised upward through water pressure force.

7. The method of claim 6, wherein the at least one channel is a first channel and wherein the at least one pin slides through a second channel when the stem is retracted downward into a housing through bias from a spring element.

8. The method of claim 7, further comprising repeating the raising and retraction of the stem for a predetermined number of steps.

9. The method of claim 5, further comprising sliding a slidable section of the cam as the at least one pin reaches a predetermined limit within the cam.

10. A method of cleaning a swimming pool comprising the method comprising:

intermittently raising a nozzle head under water and ejecting a stream of water;

incrementally rotating the nozzle head in a clockwise direction;

retracting the nozzle head;

moving a cam reverser from a first position to a second position; and reversing the direction of rotation of the nozzle head with the cam reverser to counterclockwise.

11. The method of claim 10, wherein incrementally rotating the nozzle head comprises incrementally rotating the nozzle head clockwise through the intermittent raising of the nozzle head under water, wherein the cam reverser is a first disc positioned in the nozzle head.

12. The method of claim 11, further comprising adjusting a rotational distance through which the nozzle head rotates by substituting a second disc for the first disc, the second disc being different from the first disc.

13. The method of claim 10, wherein moving the cam reverser comprises moving the cam reverser about a longitudinal axis of the nozzle head.

14. The method of claim 10, wherein the cam reverser comprises a first cam reverser, the method further comprising adjusting a rotational distance through which the nozzle head rotates by substituting a second cam reverser for the first cam reverser.

* * * * *